US007170396B2

(12) United States Patent
Kalafarski

(10) Patent No.: US 7,170,396 B2
(45) Date of Patent: Jan. 30, 2007

(54) ADDRESSABLE SMART SPEAKER

(75) Inventor: Steven C. Kalafarski, Ashburnham, MA (US)

(73) Assignee: SimplexGrinnell LP, Westminster, MA (US)

( * ) Notice: Subject to any disclaimer, the term of this patent is extended or adjusted under 35 U.S.C. 154(b) by 155 days.

(21) Appl. No.: 10/873,027

(22) Filed: Jun. 21, 2004

(65) Prior Publication Data

US 2005/0280526 A1 Dec. 22, 2005

(51) Int. Cl.
*G08B 27/00* (2006.01)

(52) U.S. Cl. ..... 340/326; 340/825.52; 340/288; 340/577; 381/59; 381/82; 381/79

(58) Field of Classification Search ..... 340/384.72, 340/384.73, 825.52, 539.22, 326; 381/82, 381/77; 700/94
See application file for complete search history.

(56) References Cited

U.S. PATENT DOCUMENTS

| | | | | |
|---|---|---|---|---|
| 4,816,809 | A | 3/1989 | Kim | |
| 5,406,634 | A | 4/1995 | Anderson et al. | |
| 5,650,775 | A * | 7/1997 | Van Steenbrugge | 340/825.24 |
| 5,952,919 | A * | 9/1999 | Merrill | 340/539.18 |
| 5,953,429 | A * | 9/1999 | Wakai et al. | 381/77 |
| 6,097,289 | A | 8/2000 | Li et al. | |
| 6,329,908 | B1 | 12/2001 | Frecska | |
| 6,900,726 | B2 * | 5/2005 | Graves | 340/531 |
| 7,027,736 | B1 * | 4/2006 | Mier-Langner et al. | 398/106 |
| 2001/0053228 | A1 * | 12/2001 | Jones | 381/77 |
| 2002/0135491 | A1 | 9/2002 | Maier, Jr. | |
| 2003/0063755 | A1 | 4/2003 | Nourse et al. | |
| 2005/0018856 | A1 * | 1/2005 | Kim et al. | 381/57 |
| 2005/0111676 | A1 * | 5/2005 | LeBlanc et al. | 381/120 |
| 2005/0222820 | A1 * | 10/2005 | Chung | 702/188 |

FOREIGN PATENT DOCUMENTS

| | | | |
|---|---|---|---|
| EP | 0740278 | A1 | 10/1996 |
| WO | WO 03/012759 | A1 | 2/2003 |

OTHER PUBLICATIONS

American Security Equipment Company, Product Specification for Select-A-Horn Series HW-24 Horn.
Simplex Product Datasheet for TrueAlert Addressable Notification Appliances published Jul. 2002 by SimplexGrinnell's Marketing Dept.

* cited by examiner

*Primary Examiner*—Jeffery Hofsass
*Assistant Examiner*—Anne V. Lai

(57) ABSTRACT

An addressable smart speaker for use in a fire alarm system connects to and receives messages over a network, has plural taps for selecting audio power. In response to a command, a selector in an addressed smart speaker selects a tap to select a particular audio power.

26 Claims, 4 Drawing Sheets

ADDRESSABLE SMART SPEAKER

BACKGROUND OF THE INVENTION

Common area indoor commercial paging systems (non-fire alarm) have used a "constant voltage" (25, 70 or 100 volt) technology for decades. Briefly, this technology allows easy distributed ceiling or wall speaker design that involve speakers that use "matching transformers" for each and every speaker in the system. These transformers permit easy calculation of how much power is needed for adequate volume in a given area.

For example, if a system consists of twenty speakers, and an adequate power for each speaker is one watt, then the driving power amplifier would have to provide at least twenty watts to adequately handle twenty speakers. Typically, though, it is more desirable to have a larger amplifier, say 50 or 100 watts, to accommodate for speakers that sound in a larger area and may require more than one watt for good sound level coverage.

This is where the transformer comes into play. Commonly, the speaker's transformer has multiple connections, or "taps," that range from ⅛ watt to as much as 30 or more watts. Again, just adding up the wattage for the system determines the size of the power amplifier that will drive it.

This same speaker technology has generally been adopted for use with audio (voice) fire alarm systems that utilize speakers to alert occupants of a building of an emergency. The warning typically consists of alert tones followed by spoken word messages that give instructions to occupants during the emergency.

The disadvantage to using this technology lies in the setting of each speaker's transformer taps. If it is deemed that a particular speaker is not loud enough in a given area, the service technician must remove the speaker from the wall or ceiling, move the tap connector to the next higher tap setting, re-install the speaker and then test the output, usually with a dB meter, to see if the audio is now loud enough. (NFPA 72 "National Fire Alarm Code" requires that speakers used in fire alarm systems produce a sound that is at least 15 dB above the ambient noise level of a given area).

This is, more or less, a trial-and-error method of setting speaker loudness, and may have to be repeated several times. One of the biggest factors in determining proper dB levels lies in the actual construction material of the area in question, and the anticipated ambient noise level. There are methods to predict the required dB level before installation, but it is cumbersome and expensive to make this prediction, particularly if there are unknowns involved, usually in new construction situations. Thus, these predictive methods are not widely used for fire alarm systems.

SUMMARY OF THE INVENTION

Using fire alarm system addressable notification appliance technology, such as SimplexGrinnell LP's TrueAlert® technology as described in U.S. Pat. No. 6,426,697, "Alarm System Having Improved Communication," incorporated by reference herein in its entirety, the tap of a speaker according an embodiment of the present invention can be set by addressing the speaker and commanding it, from a fire alarm control panel, to a particular tap setting, eliminating the need to remove the speaker from the ceiling or wall. If a speaker is deemed to be below an acceptable dB level, all that is needed is to select the "address" of that speaker, and set the new tap level, repeating the procedure until the desired level is achieved. Of course, an amplifier of adequate headroom power is necessary. Typically, many or most installations have more than enough amplifier power to accommodate changes of this type.

With the anticipated adoption of a new NFPA code that will require an acceptable level of a new audio element, called "intelligibility," the need to set speaker tap levels becomes even more critical.

In accordance with an embodiment of the invention, an addressable smart speaker for use in a fire alarm system comprises a network interface which connects to and receives messages over a network, means for assigning an address to the speaker, plural taps for selecting audio power, and a selector which selects at least one of said plural taps to select a particular audio power as directed by a received network command addressed to said speaker.

A method according an embodiment of the present invention for communication in a fire alarm system includes the steps of: sending a message addressed to an addressable speaker, the message including a command to control the speaker; and at the addressable speaker, implementing said command.

BRIEF DESCRIPTION OF THE DRAWINGS

The foregoing and other objects, features and advantages of the invention will be apparent from the following more particular description of preferred embodiments of the invention, as illustrated in the accompanying drawings in which like reference characters refer to the same parts throughout the different views. The drawings are not necessarily to scale, emphasis instead being placed upon illustrating the principles of the invention.

DETAILED DESCRIPTION OF THE INVENTION

A description of preferred embodiments of the invention follows.

Figure 1:
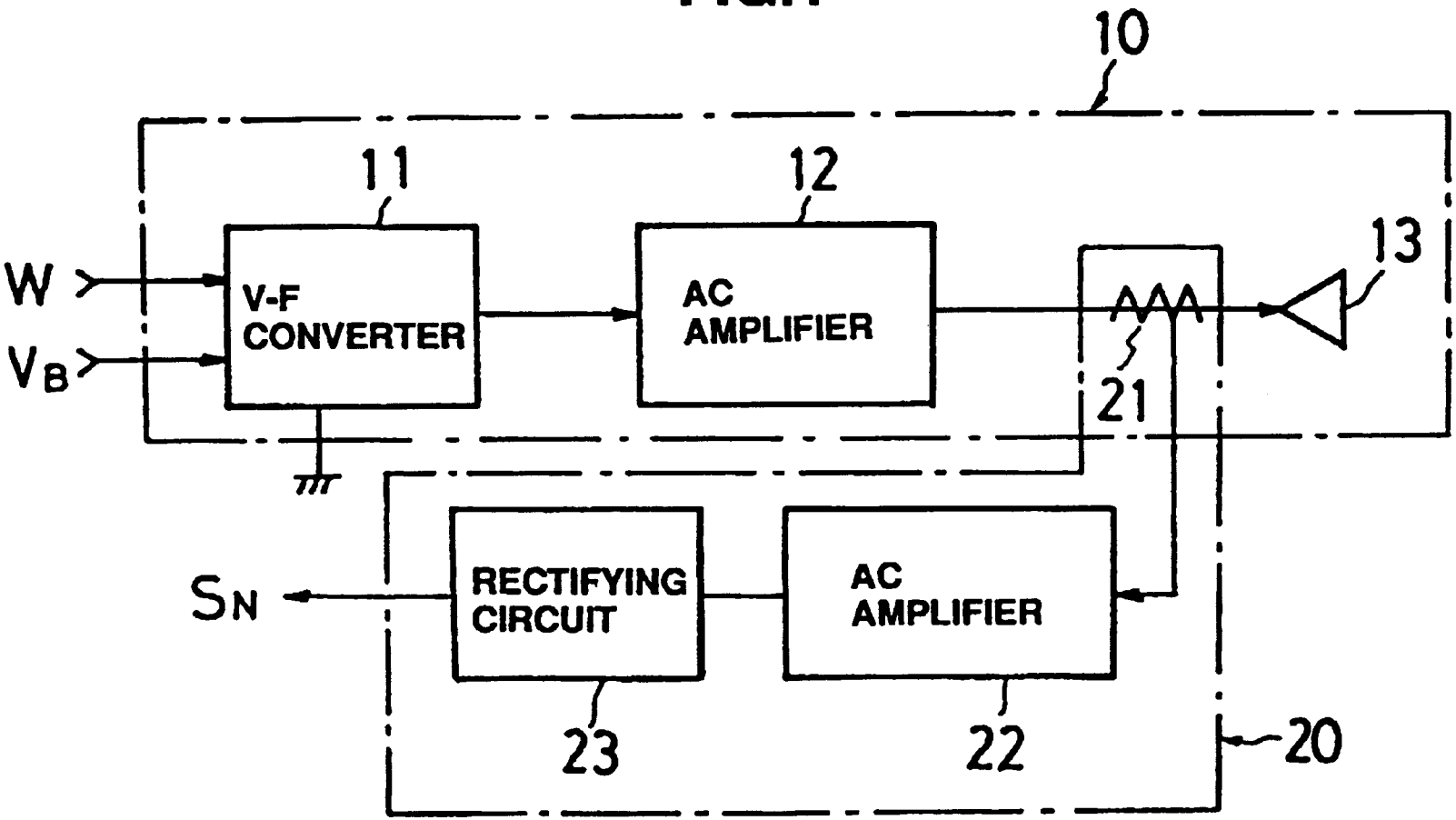
FIG. 1 is a schematic diagram illustrating a system embodying the present invention.

A system embodying the present invention is illustrated in FIG. 1. The system includes one or more notification appliance circuits (NACs), i.e., networks 16, having alarm condition detectors D and alarm notification appliances A. Alternatively, the detectors and notification appliances may be on separate networks. The detectors D are monitored by a system controller 14. When an alarm condition is sensed, the system controller 14 signals the alarm to the appropriate notification appliances through one or more networks 16. Notification appliances may include, for example, a visual alarm (strobe), an audible alarm (horn), a speaker, or a combination thereof.

Although not necessary for carrying out the invention, as shown, all of the notification appliances in a network are coupled across a pair of power lines 18 and 20 that advantageously also carry communications between the system controller 14 and the notification appliances A. The audio signal is generally carried to appliances with speakers over a separate circuit (described below with reference to FIG. 2).

Figure 2:
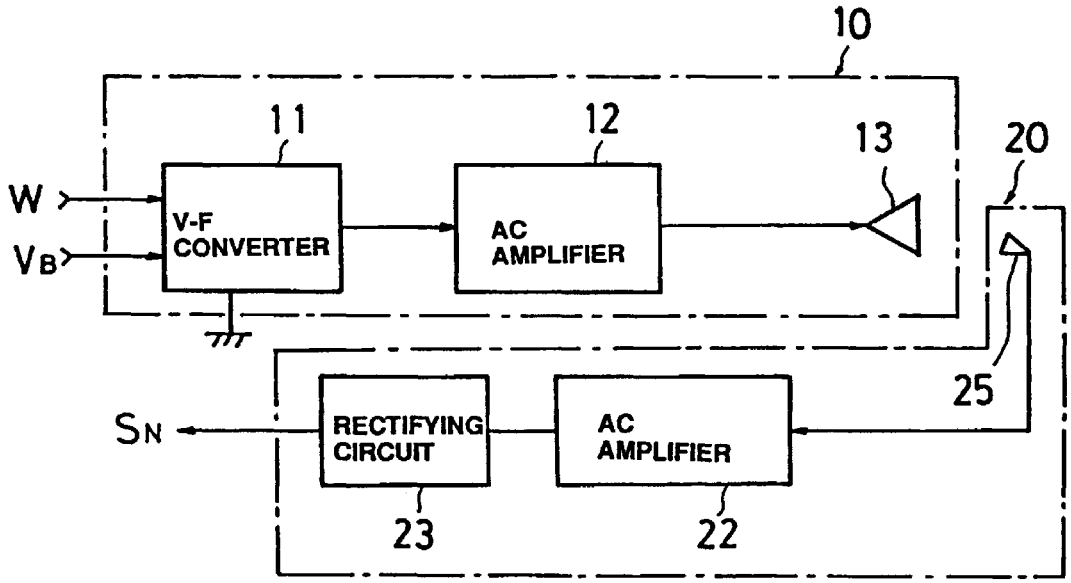
FIG. 2 is a schematic diagram showing a simplified notification appliance circuit with two addressable smart speakers according to an embodiment of the present invention.

FIG. 2 is a schematic diagram showing a simplified notification appliance circuit 16 with two addressable smart speakers 33 according to an embodiment of the present invention. Each speaker 33 has been assigned a unique address, in this example 1 and 2 respectively. The speakers 33 communicate with a system controller 14, or fire alarm control panel (FACP), via a notification appliance circuit 16. A separate speaker circuit 31 provides an audio signal to the speakers 33. Software 8 within the system controller 14 addresses the individual speakers, for example, to set speaker taps.

Figure 3:
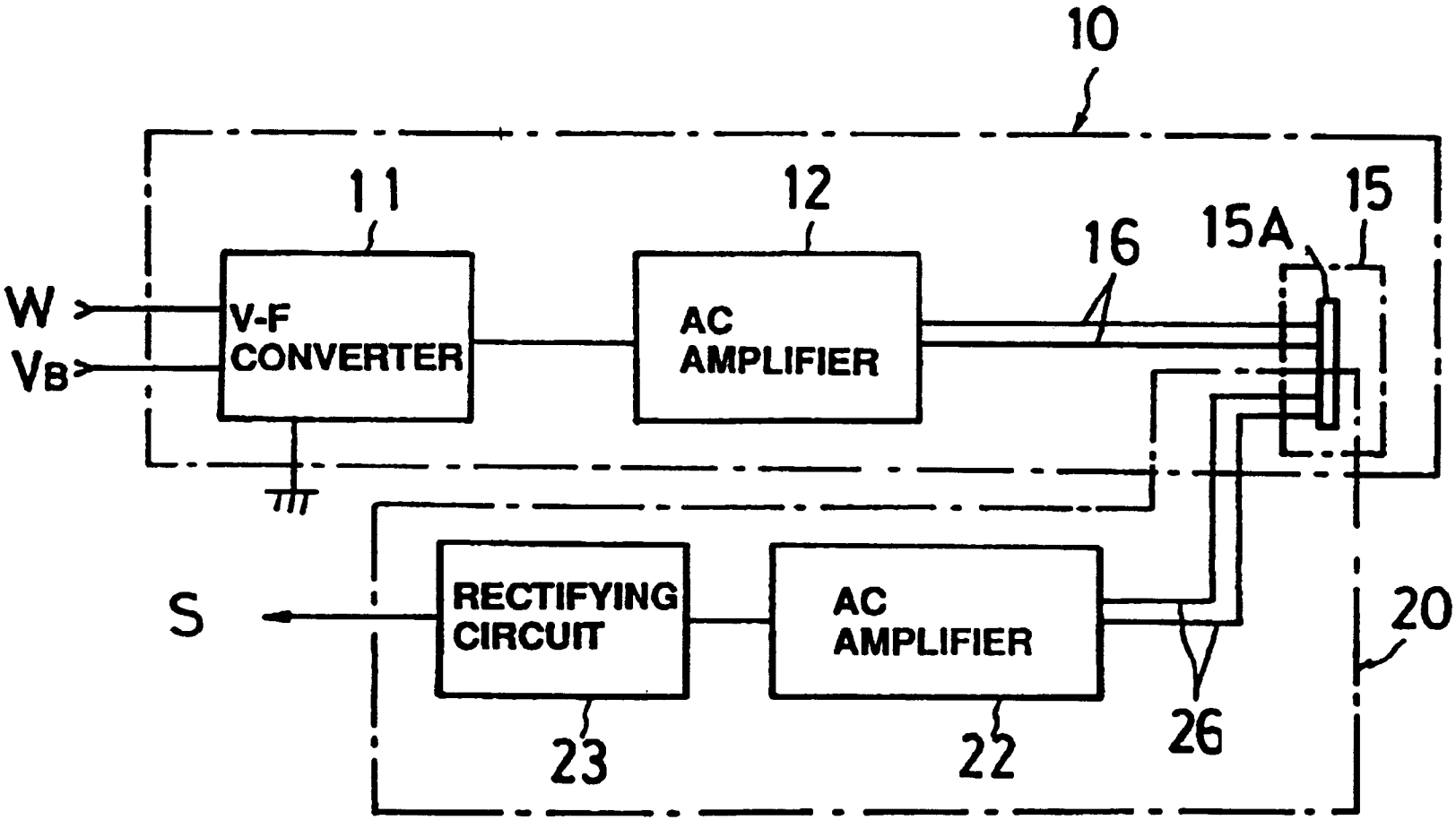
FIG. 3 is a schematic diagram of an addressable smart speaker of FIG. 2.

FIG. 3 is a schematic diagram of an addressable smart speaker 33 of FIG. 2. The addressable smart speaker 33 as shown includes an audio transducer 41, and optionally, a strobe 43. A network interface 45 connects to the notification appliance circuit 16. A control circuit 47, which may comprise, for example, a microprocessor or simple circuitry, determines from the speaker's address 51 whether a received message is intended for the device.

A strobe candela selection circuit 49 controls, in response to a properly addressed candela setting message, the strobe's candela setting, as discussed in U.S. Ser. No. 60/528,952, "Programmable Multi-Candela Notification Device," filed Dec. 11, 2003 and incorporated by reference herein in its entirety.

A speaker tap selection circuit 53, in response to a received command as interpreted by the control circuit 47, selects a tap to provide a selected power to the transducer 41.

Many speakers used in fire alarm systems typically use 25 or 70-volt amplifiers (not shown). These speakers provide multiple sets of taps (not shown), one for each voltage. An addressable speaker according to an embodiment of the present invention allows the selection of any tap, for setting the desired power at the proper voltage.

Figure 4:
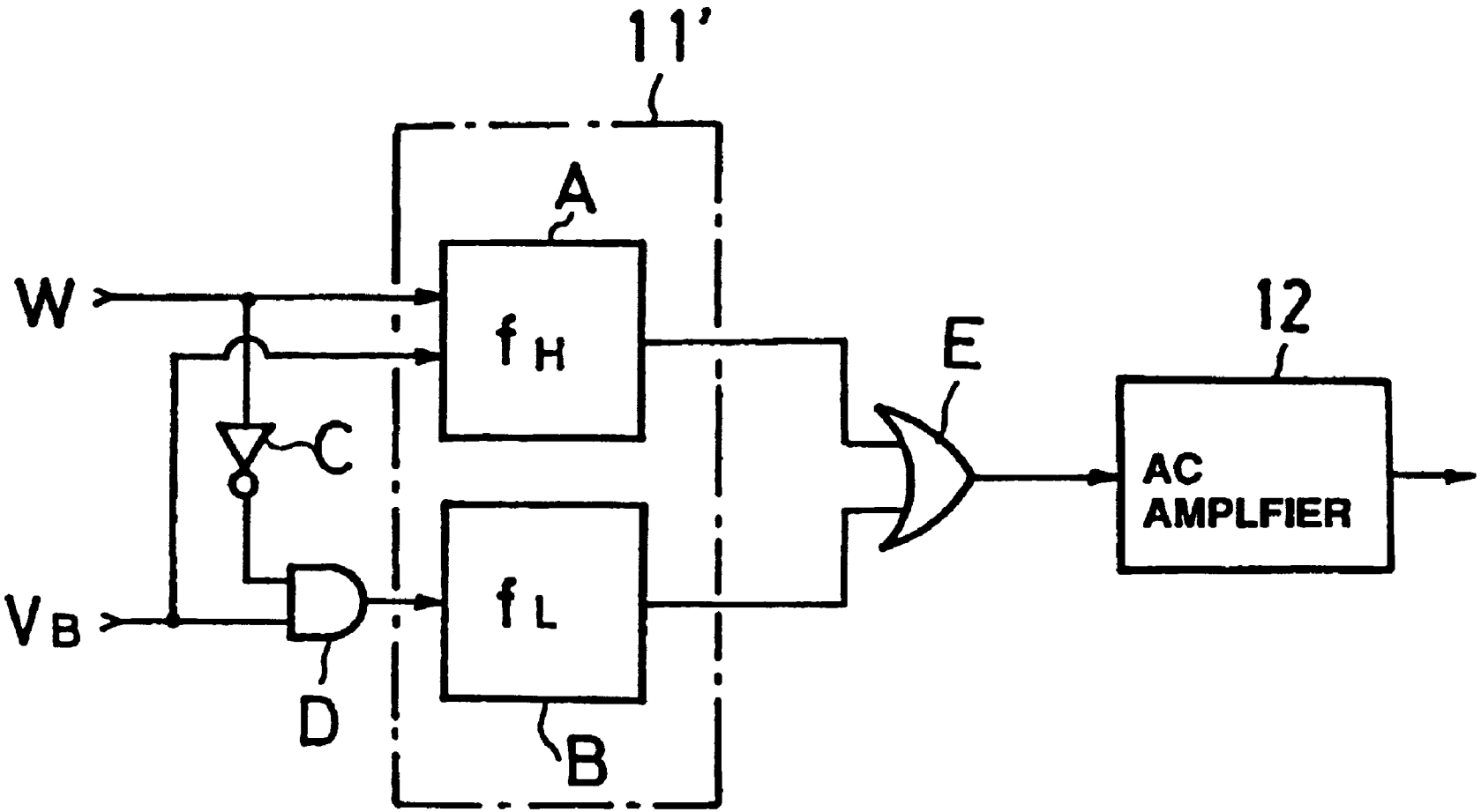
FIG. 4 is a schematic diagram illustrating the use of the present invention to implement a virtual speaker circuit.
Figure 1:
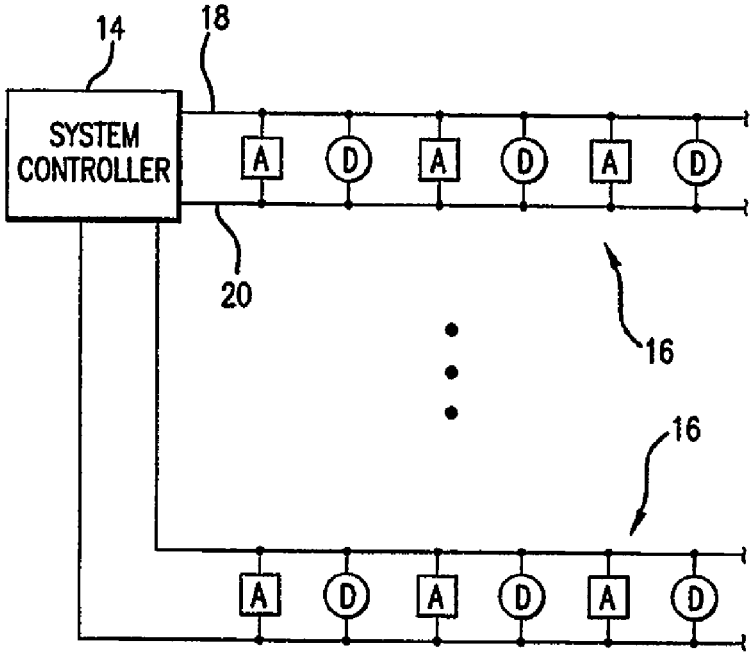
Figure 2:
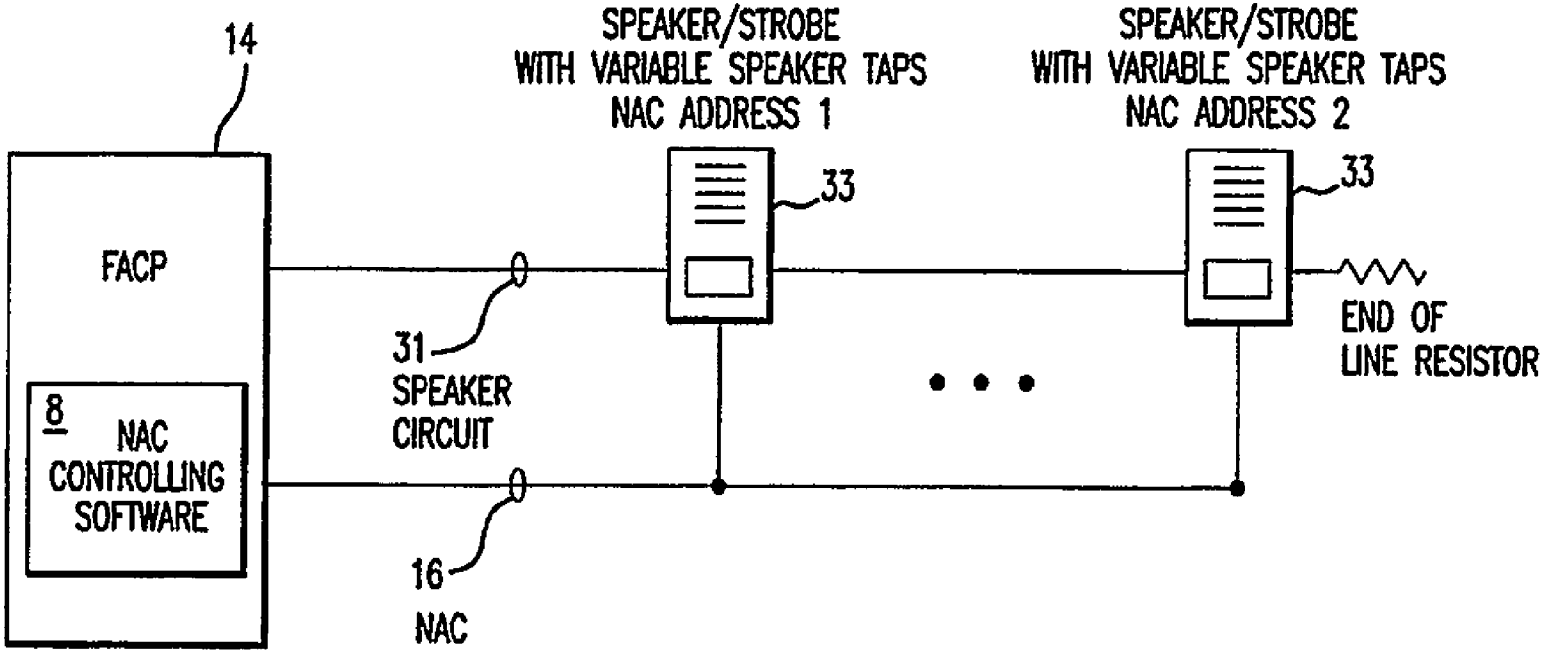
Figure 3:
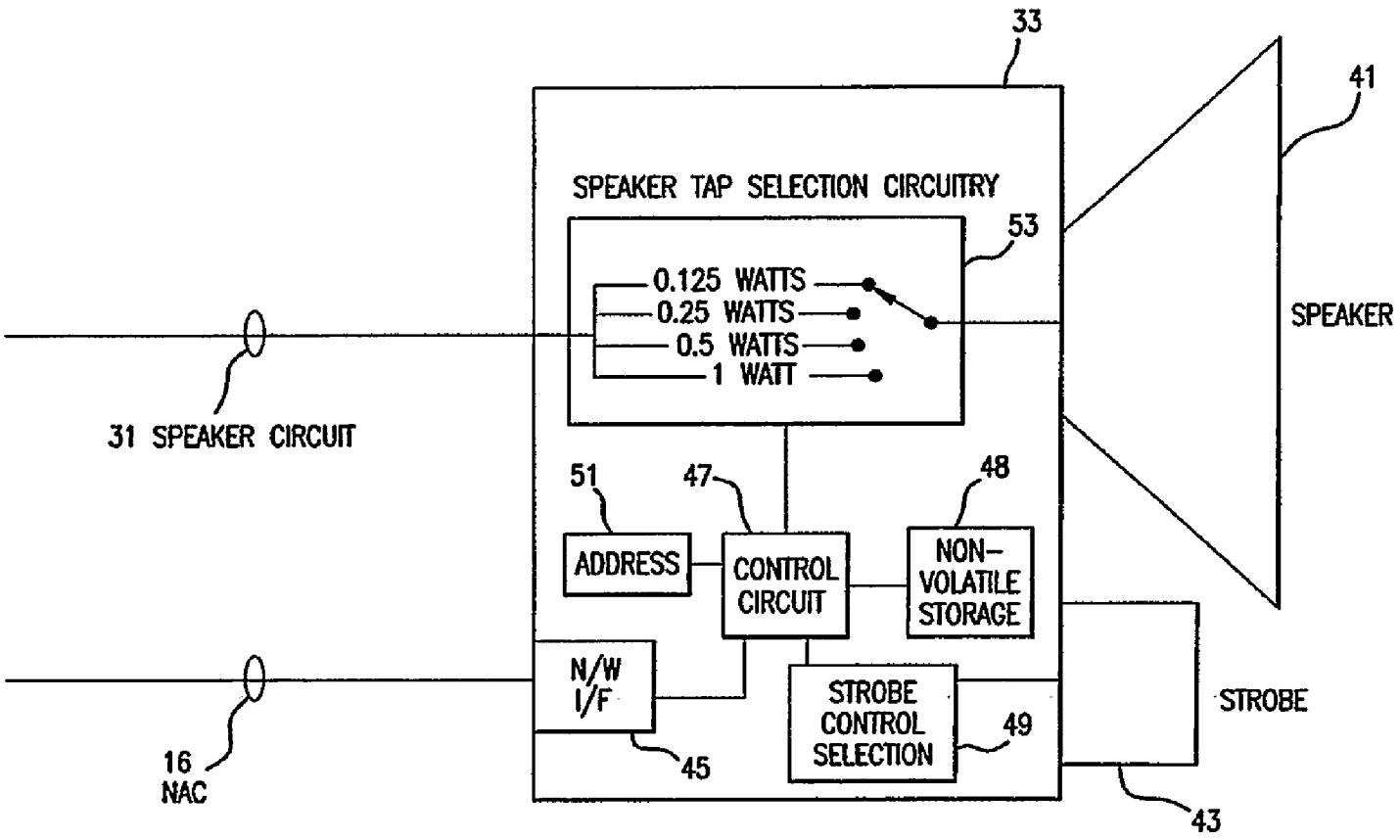
Figure 4:
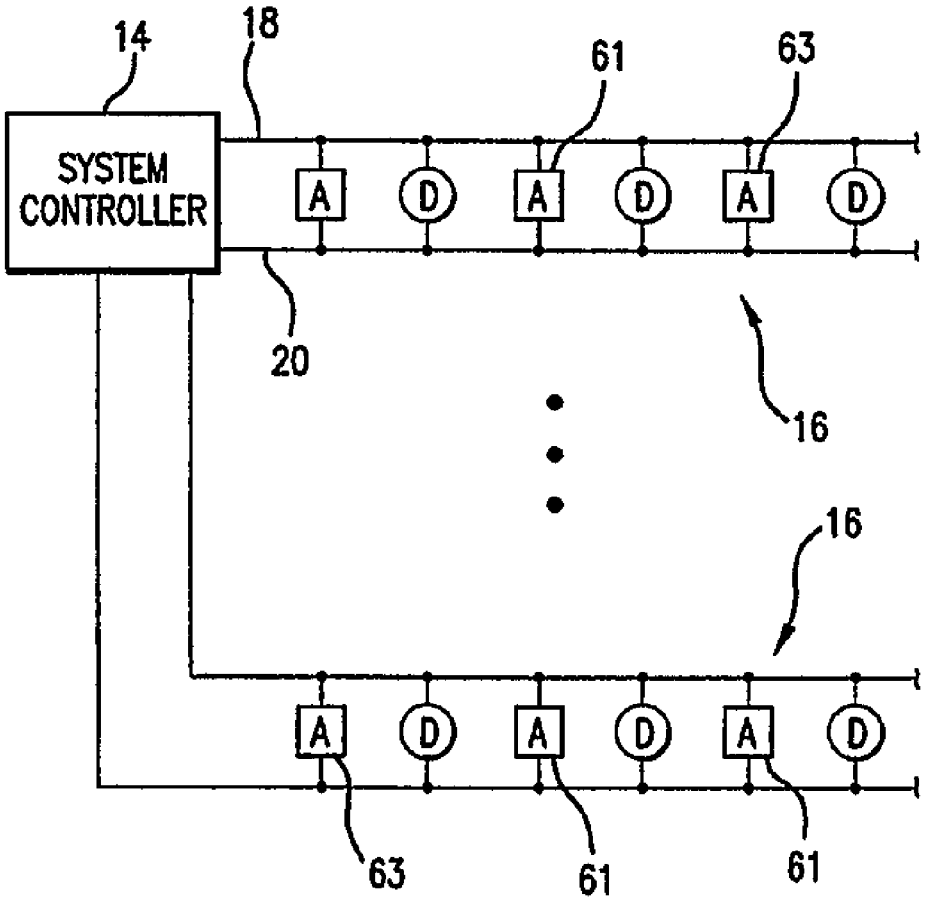

The fire alarm control panel may be configured to treat groups of addressable speakers located across multiple NACs as virtual speaker circuits. FIG. 4, which shows the same system as FIG. 1, illustrates this concept. Here, the system controller 14 can treat the smart addressable speakers referenced as 61 as a virtual speaker circuit, providing the same command to each in parallel, or using a group address (provided the speakers have been assigned a group address). The speakers referenced as 63 may be treated as a second virtual speaker circuit.

Besides selecting the tap setting, other commands are available. The following commands are presented as examples and in no way are meant to limit the scope of the present invention. The specific circuitry to implement such features is not shown, but is well within the knowledge of one skilled in the art.

For example, additional commands instruct the addressed speaker to activate or de-activate. These commands can be addressed to an individual speaker, a group of speakers, a virtual speaker circuit, or globally to all speakers. An activated speaker will broadcast the audio signal it receives from the speaker circuit 31 (FIG. 3), while an inactivated speaker will remain silent.

The ability to activate/de-activate individual speakers enables the setting of various modes on a per-speaker basis, rather than on a per-circuit basis. For example, an addressable smart speaker may be commanded to any of the following modes of operation: strobe only; speaker only; or both strobe and speaker on. This allows the system controller 14 to operate individual speakers or groups of speakers not necessarily on the same network in on-until-silenced or on-until-reset modes, as desired.

A benefit of the present invetion is that it enables activation of a different speaker or group of speakers for other applications such as live voice messages during an emergency, automatic alarm activation or routine paging.

Another embodiment provides speaker circuit supervision. One type of supervision involves sending an audio tone of 20 KHz (beyond normal human hearing, i.e., an ultrasonic tone). An addressable speaker according to an embodiment of the present invention monitors the tone and, upon loss of that tone, transmits a message via the network to the fire alarm control panel indicating the trouble, the message identifying the speaker.

A fire alarm control panel allows fire alarm circuits such as SimplexGrinnell LP's TrueAlert® addressable circuits to be distributed in various areas of a building; for example, a controller on each floor of a high-rise building. This allows controlling riser/network circuits that can be run for long distances and that control localized addressable speaker/strobe and horn circuits. This kind of network control is common networked fire alarm control systems, particularly in a campus style setting.

Addressable speakers according to an embodiment of the present invention can also be configured into virtual speaker networks, to deliver background music and/or paging capabilities.

While this invention has been particularly shown and described with references to preferred embodiments thereof, it will be understood by those skilled in the art that various changes in form and details may be made therein without departing from the scope of the invention encompassed by the appended claims.

What is claimed is:

1. A notification appliance for use in a fire alarm system, the notification appliance comprising:

a network interface which connects to and receives messages over a network;

means for assigning an address to the notification appliance;

a speaker plural taps for selecting audio power for the speaker;

a first selector which selects at least one of said plural taps to select a particular audio power for the speaker as directed by a received network command addressed to said notification appliance;

a visual indicator;

plural settings for selecting intensity for the visual indicator;

a second selector which selects at least one of the plural settings to select a particular intensity for the visual indicator as directed by a received network command addressed to the notification appliance;

mode selector for selecting modes of the notification appliance as directed by a received network command addressed to the notification appliance, the modes comprising speaker operation only, visual indicator operation only, and speaker and visual indicator operation.

2. The notification appliance of claim 1, further comprising non-volatile storage for storing information about the last-selected audio power setting.

3. The notification appliance of claim 1, wherein the visual indicator comprises a strobe.

4. A notification appliance for use in a fire alarm system, the notification appliance comprising:

a network interface which connects to and receives messages over a network;

a speaker;

a visual indicator;

a mode selector for selecting modes of the notification appliance, the modes comprising speaker operation only, visual indicator operation only, and speaker and visual indicator operation a controller for implementing a received network command, the command comprising an address addressed to said notification appliance and a message for the controlling the speaker, the visual indicator, or the mode selector.

5. The notification appliance of claim 4 wherein the command is a command to set a transformer tap.

6. The notification appliance of claim 4 wherein the command is a command to select a voltage type.

7. The notification appliance of claim 4 wherein the notification appliance is responsive to a group address.

8. The notification appliance of claim 4 wherein the command is one of an activation and a de-activation command.

9. The notification appliance of claim 4, further comprising non-volatile storage for storing command information.

10. The notification appliance of claim 4 wherein said notification appliance in conjunction with similar notification appliances are controlled as a virtual notification appliance circuit.

11. The notification appliance of claim 1, wherein at least two said notification appliances are on different networks.

12. The notification appliance of claim 4, the network interlace further transmitting a response generated by the controller over the network.

13. The notification appliance of claim 4, further comprising:

a tone generator which generates an ultrasonic tone; and a detector for detecting the ultrasonic tone, the notification appliance transmitting a trouble message over the network if the ultrasonic tone is not detected, the message providing a notification appliance identification.

14. The notification appliance of claim 4, wherein the visual indicator comprises a strobe.

15. A method for communication in a fire alarm system, comprising:

sending a message addressed to an addressable notification appliance, the message including an address and a command to control one or both of a speaker and a visual indicator in the notification appliance or indicative of a mode setting, the mode setting for speaker operation only, visual indicator operation only, and speaker and visual indicator operation; and at said addressable notification appliance, implementing said command.

16. The method of claim 15 wherein the command is a command to set a transformer tap.

17. The method of claim 15 wherein the command is a command to select a voltage type.

18. The method of claim 15 wherein the notification appliance is responsive to a group address.

19. The method of claim 15 wherein the command is one of an activation and a de-activation command.

20. The method of claim 15, further comprising:

storing command information in non-volatile storage.

21. The method of claim 15, further comprising:

controlling said notification appliance in conjunction with similar notification appliances as a virtual notification appliance circuit.

22. The method of claim 21 wherein at least two said notification appliances are on different networks.

23. The method of claim 15, further comprising:

transmitting a response to the received command over the network.

24. The method of claim 15, further comprising:

generating an ultrasonic tone;

detecting the ultrasonic tone; and transmitting a trouble message over the network if the ultrasonic tone is not detected, the message providing a notification appliance identification.

25. A notification appliance for use in a fire alarm system, comprising:

means for assigning an address to the notification appliance;

speaker means;

means for selecting audio power for the speaker means;

first selector means for selecting a particular audio power;

visual indicator means;

means for selecting intensity for the visual indicator means;

second selector means for selecting a particular intensity for the visual indicator means;

mode selector means for selecting modes of the notification appliance, the modes comprising speaker means operation only, visual indicator means operation only, and speaker means and visual indicator means operation;

communications means for receiving a message addressed to said notification appliance, the message including an address and a command; and means for implementing said command.

26. The notification appliance of claim 25, wherein the visual indicator means comprises a strobe means.

* * * * *

UNITED STATES PATENT AND TRADEMARK OFFICE

CERTIFICATE OF CORRECTION

PATENT NO. : 7,170,396 B2
APPLICATION NO. : 10/873027
DATED : January 30, 2007
INVENTOR(S) : Steven Kalfarski It is certified that error appears in the above-identified patent and that said Letters Patent is hereby corrected as shown below:

Delete Title page illustrating a figure, and substitute therefor, new Title page illustrating a figure. (attached)

Delete drawing sheets 1-4, consisting of figures 1-4, and substitute therefor drawing sheets 1-4, consisting of Figures 1-4, as shown on the attached sheet.

Column 5, line 8, after "and a message for" delete --the--.

Signed and Sealed this

Twenty-fourth Day of April, 2007

JON W. DUDAS
*Director of the United States Patent and Trademark Office*

(12) United States Patent
Kalafarski

(10) Patent No.: US 7,170,396 B2
(45) Date of Patent: Jan. 30, 2007

(54) ADDRESSABLE SMART SPEAKER

(75) Inventor: Steven C. Kalafarski, Ashburnham, MA (US)

(73) Assignee: SimplexGrinnell LP, Westminster, MA (US)

( * ) Notice: Subject to any disclaimer, the term of this patent is extended or adjusted under 35 U.S.C. 154(b) by 155 days.

(21) Appl. No.: 10/873,027

(22) Filed: Jun. 21, 2004

(65) Prior Publication Data

US 2005/0280526 A1 Dec. 22, 2005

(51) Int. Cl.
*G08B 27/00* (2006.01)

(52) U.S. Cl. ..... 340/326; 340/825.52; 340/288; 340/577; 381/59; 381/82; 381/79

(58) Field of Classification Search ..... 340/384.72, 340/384.73, 825.52, 539.22, 326; 381/82, 381/77; 700/94
See application file for complete search history.

(56) References Cited

U.S. PATENT DOCUMENTS

| | | | | |
|---|---|---|---|---|
| 4,816,809 | A | 3/1989 | Kim | |
| 5,406,634 | A | 4/1995 | Anderson et al. | |
| 5,650,775 | A * | 7/1997 | Van Steenbrugge | 340/825.24 |
| 5,952,919 | A * | 9/1999 | Merrill | 340/539.18 |
| 5,953,429 | A * | 9/1999 | Wakai et al. | 381/77 |
| 6,097,289 | A | 8/2000 | Li et al. | |
| 6,329,908 | B1 | 12/2001 | Frecska | |
| 6,900,726 | B2 * | 5/2005 | Graves | 340/531 |
| 7,027,736 | B1 * | 4/2006 | Mier-Langner et al. | 398/106 |
| 2001/0053228 | A1 * | 12/2001 | Jones | 381/77 |
| 2002/0135491 | A1 | 9/2002 | Maier, Jr. | |
| 2003/0063755 | A1 | 4/2003 | Nourse et al. | |
| 2005/0018856 | A1 * | 1/2005 | Kim et al. | 381/57 |
| 2005/0111676 | A1 * | 5/2005 | LeBlanc et al. | 381/120 |
| 2005/0222820 | A1 * | 10/2005 | Chung | 702/188 |

FOREIGN PATENT DOCUMENTS

| | | | |
|---|---|---|---|
| EP | 0740278 | A1 | 10/1996 |
| WO | WO 03/012759 | A1 | 2/2003 |

OTHER PUBLICATIONS

American Security Equipment Company, Product Specification for Select-A-Horn Series HW-24 Horn.
Simplex Product Datasheet for TrueAlert Addressable Notification Appliances published Jul. 2002 by SimplexGrinnell's Marketing Dept.

* cited by examiner

*Primary Examiner*—Jeffery Hofsass
*Assistant Examiner*—Anne V. Lai

(57) ABSTRACT

An addressable smart speaker for use in a fire alarm system connects to and receives messages over a network, has plural taps for selecting audio power. In response to a command, a selector in an addressed smart speaker selects a tap to select a particular audio power.

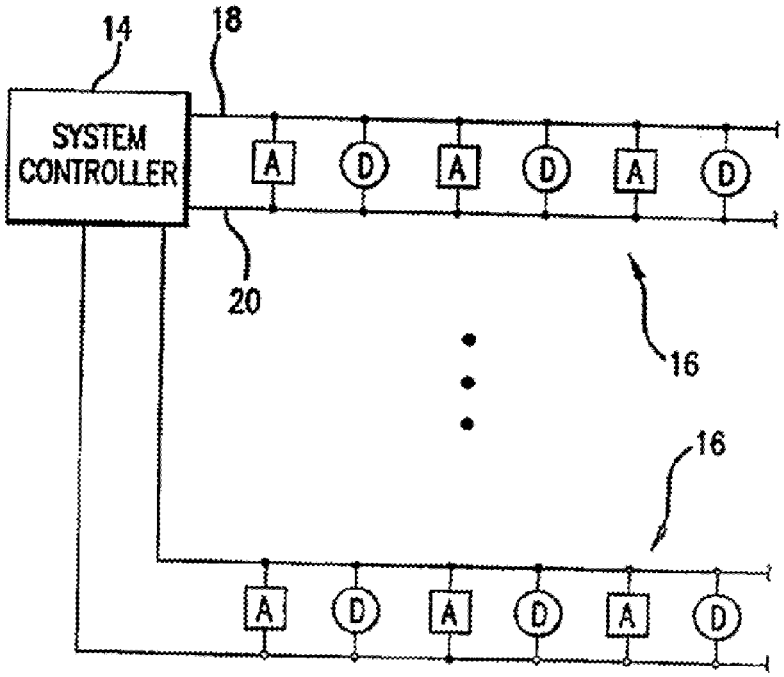

26 Claims; 4 Drawing Sheets